United States Patent [19]

Burdenko

[11] Patent Number: 4,934,689

[45] Date of Patent: Jun. 19, 1990

[54] SWIMMING POOL APPARATUS FOR DEEP WATER WALKING AND RUNNING

[76] Inventor: Igor Burdenko, 34 Joyce Rd., Wayland, Mass. 01778

[21] Appl. No.: 315,819

[22] Filed: Feb. 27, 1989

[51] Int. Cl.[5] ..... A63B 1/00

[52] U.S. Cl. ..... 272/70; 272/71; 272/116; 272/1 B

[58] Field of Search ..... 272/69, 70, 71, 1 R, 272/1 B, 116; 4/88, 89, 92, 94, 95, 513; 441/116

[56] References Cited

U.S. PATENT DOCUMENTS

| | | | |
|---|---|---|---|
| 3,956,779 | 5/1976 | Jewett | 272/1 B |
| 4,183,329 | 1/1980 | Leonaggeo | 4/492 |
| 4,551,108 | 11/1985 | Bass | 272/1 B |
| 4,776,581 | 10/1988 | Shepherdson | 272/71 |

FOREIGN PATENT DOCUMENTS

| | | | |
|---|---|---|---|
| 0262590 | 12/1988 | Fed. Rep. of Germany | 272/71 |

*Primary Examiner*—Stephen R. Crow

*Attorney, Agent, or Firm*—David Pressman

[57] ABSTRACT

An underwater closed-loop track consists of at least two tracks (12 and 14) which are formed of floating pads (16 and 18 ) connected in series and containing weights (22) for maintaining the pads at a predetermined depth from the surface of water. The underwater track is supported by flexible links, e.g., by ropes, connected to stationary supports (S1 and S2). The external track (12) has a depth suitable for walking and running in water on the bottom formed by the pads, while the external track (14) has a depth for running in water without touching the bottom. Another embodiment of the invention relates to a stationary swimming pool of a closed-loop configuration (40) or a zig-zag configuration (66) having at least two tracks, one of which is suitable for running and walking in water with touching the bottom, and another for running in water without touching the bottom. The bottom may have an uneven profile, while resistance to walking and running can be changed by means of jet nozzles (53 and 55) installed on the path of the user.

10 Claims, 5 Drawing Sheets

I. Burdenko

Sheet 5 of 5

SWIMMING POOL APPARATUS FOR DEEP WATER WALKING AND RUNNING

BACKGROUND—FIELD OF THE INVENTION

The present invention relates to the field of sports equipment, particularly to a swimming pool apparatus for deep water walking and running.

BACKGROUND—DESCRIPTION OF THE PROBLEM

As a result of modern lifestyles, with all their technical conveniences, people do not make full use of their physical capacities, thus leading to all sorts of physical problems resulting from hypodynamia (underuse of physical capacities). Although jogging has been known for a long time, it became more popular when in the 1960's Dr. Gilmore of New Zealand strongly suggested it an efficient, easily accomplished form of exercise for maintaining physical fitness. Since then jogging has become extremely popular all over the world. People of various ages and sexes began to jog wherever possible: in the streets, parks, and roads.

It was thought that this new sport would help prevent many diseases and health problems, especially heart attacks. Time, however, showed it not be the ideal physical activity. Many people died while jogging, and many others developed serious orthopedic problems, e.g., pains in the legs, joints, spine, etc. Still other joggers were deterred because of headaches and problems in the heart, kidneys, liver, etc. For some joggers, the stress and the strain on the joints appeared to be unbearable. Also, jogging on roads and streets presented a danger because of carbon monoxide from vehicles and the risk of being hit by a vehicle. Lastly many jogging conditions could be detrimental, e.g., irregular or slick ground surfaces, darkness, extreme heat, and extreme cold.

As a result, toward the end of the 1980's many people are switching from jogging to fast walking, so that the latter now is the passion of millions. For many people, however, this activity is still beyond their ability. The reason is the effect of gravity (gravitation), which makes it difficult and tiring for some people to walk very far. In water, where the body weighs one tenth as much, the stress to the body associated with jogging as well as walking is eliminated. In view of this, water exercises, which offer more benefits than any other known activity, have become a type of activity used by athletes to supplement a training program and by doctors for treatment and rehabilitation of patients with certain problems. Studies which I have carried out for the last 20 years prove that running or walking in water with touching or without touching the bottom completely precludes any risk of injury to the body. This is because, as stated, in water gravitation problems are decimated. Running in water is accessible to people of practically any age or sex and, with the use of a special floating vest, does not depend on the ability of a person to swim.

However, walking in water has not been completely satisfactory because walking alone did not provide sufficient loading. Therefore attempts have been made to develop exercise equipment for jogging or walking in water. One such exercising apparatus is shown and described in U.S. Pat. No. 4,576,376 to P. Miller, 1986. The apparatus comprises a treadmill having a tank filled with water to provide buoyancy to a person walking or running on an endless belt-like treadmill. While running, the person holds onto the front wall or side walls of the tank and pushes the belt into movement in the direction opposite to the direction of the person's movement. The apparatus also has a handwheel which controls a valve and a pump used for creating jets to adjust the resistance during exercising.

The Miller apparatus, however, has a number of disadvantages: it is designed for one person and cannot be used by several people simultaneously; it provides an extremely monotonous imitation of jogging instead of actual running over an uneven surface; it trains only the muscles of legs as the person is immersed to below shoulder level and holds the walls of the tank during exercising. I.e., the hand muscles and shoulder joints are not working. Also the tank has a limited volume and cannot be used for swimming, and the requirement of movable parts makes the construction more complicated and requires the use of seals, bearings, etc. Further, the tank occupies a considerable space and cannot be removed when it is not in use and the surface of the endless belt is flat and cannot simulate actual jogging conditions.

OBJECTS AND ADVANTAGES OF THE INVENTION

Therefore it is an object of the invention to provide an exercise apparatus which uses a swimming pool or the like and which can eliminate inconveniences associated with exercising in a water-filled tank having a limited space. Another object is to provide such an apparatus which can be used simultaneously by many people for swimming as well as for water walking or deep water running. Further objects are to provide a water walking/running pool which makes it possible for a person to train all groups of muscles, i.e., muscles of legs, shoulders, etc., to provide a water-exercising pool which is simple in construction and has no moveable parts, to provide a pool which has variable and adjustable conditions for water walking or running, to provide a pool for walking or running over an uneven surface, to provide a pool for walking or running in water which can be quickly installed in any existing water pool or in an open water basin, and to provide novel and improved exercise tracks for pool use. Additional objects, features, and advantages of the invention will be understood after consideration of the ensuing description and the accompanying drawings.

DRAWINGS

Figure 1:
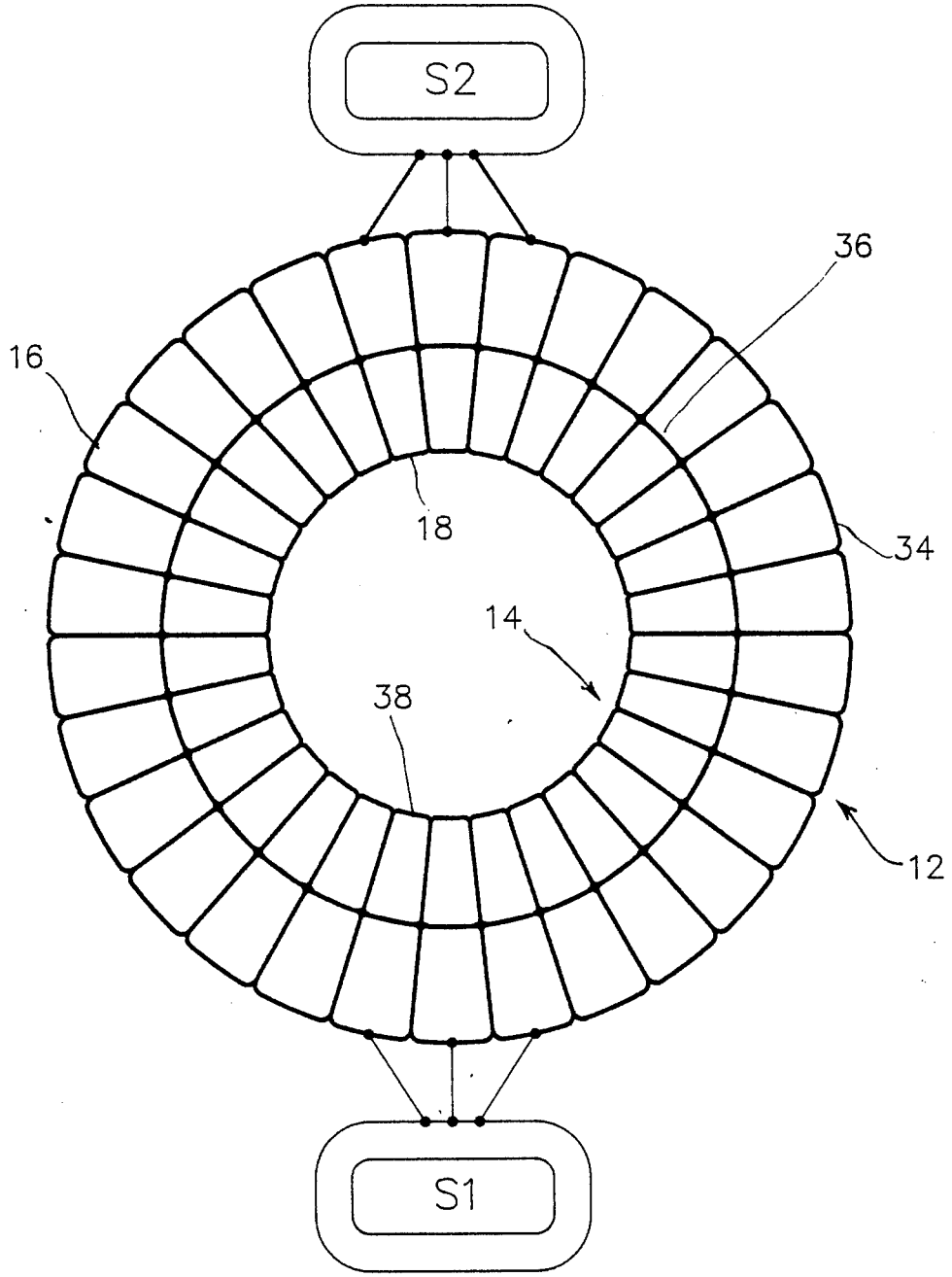
FIG. 1 is a schematic top view of two closed-loop tracks according to the invention for deep water walking or running.

REFERENCE NUMERALS USED IN THE DRAWINGS AND DESCRIPTION 12, 14—tracks
16, 18—floating pads
19, 21—ropes
20—pocket
22—weight
24—flap
26—button
28—hook
30—loop
31, 32—hinge-like cylindrical portion
34, 36, 38—boundary strips
40—water pool complex
43—bottom of the track
44, 46—track path
44*a*, 46*a*—side walls
45—concrete
47—rubber layer
49—sealant
50—ladders
51—projections
52—inner side walls
53, 55—nozzles
54—island
56, 58—exercise pools
60—main floor area
62, 64—bridges
66—labyrinth-type pool
68—track
70—linear portion of the track
72—sinusoidal portion of the track
74, 76—connecting passages
78, 80, 82—islands
84—main floor area
86, 88, 90, 92, 94, 96—bridges
S1, S2—stationary supports
R—runner

FIGS. 1-4—DESCRIPTION—FLOATING TRACK FOR WATER-WALKING OR DEEP-WATER RUNNING

In its simplest and most achievable form, the principle of the present invention can be put into practice in the form of a closed-loop floating under track submerged to predetermined depth in a pool or large body of water, such as a river, lake, or sea.

In the context of the present patent application, the words "underwater track", "deep-water running", or ""water walking" mean that an individual is running or walking while touching an underwater track, or is running without touching the track, but that his/her head is always above the water level.

FIG. 1 is a top view of two concentric tracks 12 and 14. Two tracks are shown only as an example: only one track or more than two concentric tracks can be used. As shown, each track has a closed circular configuration and consists of a series of separate hinged, hooked, or pivotally connected floating pads, such as 16 and 18. It is understood that the circular configuration is shown only as an example and that the tracks may have an oval, rectangular, or any other closed or open configuration.

Each pad (16 or 18) comprises a rectangular body made from floatable material, such as cork, plastic foam, wood, etc. The pad has a pocket or a cavity 20 (FIG. 2) to receive a load or weight 22 for adjusting its buoyancy. Load 22 may be a block of metal or any other material which is heavier than water. Pocket or cavity 20 may have a flap 24 for closing the pocket and keeping load 22 in place. The flap can be locked in a closed position by a button or snap 26. Each pad 16 or 18 may have a length of 50–200 cm, a width of 70–150 cm, and a thickness of 20–40 cm.

Figure 2:
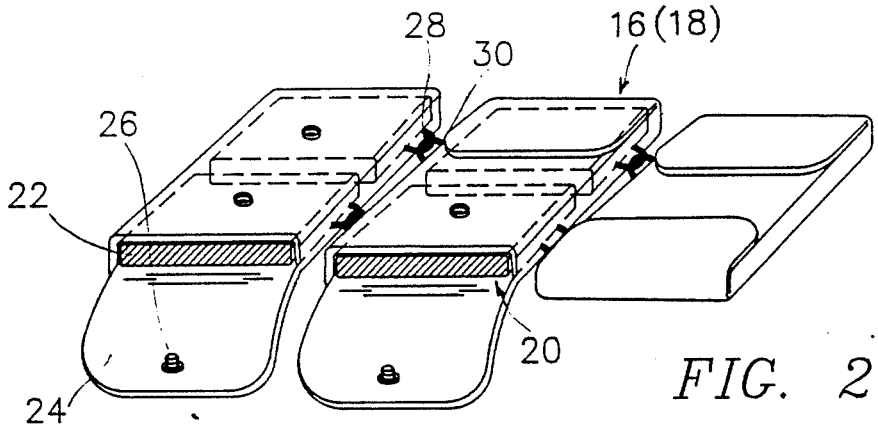
FIG. 2 is a perspective view of several floating elements which form the tracks shown in FIG. 2.

Pads 16 (18) can be interconnected by snap-closable hooks 28 on one pad and loops 30 on the adjacent pad (FIG. 2). The pads can be interconnected also by means of an outer hinge-like cylindrical portion 31 (FIG. 3) on one pad and an inner hinge-like cylindrical portion 32 formed on the adjacent pad and is insertable into cylindrical portion 30. In order to provide reliable support for the feet of people exercising on the track, the distance between adjacent pads on a track (16 or 18) should not exceed 3 cm.

The two-track unit in FIG. 1 may have an external radius of 10 m or more and an internal radius of 7 m or more, depending on the size of the available pool of water.

In order to protect the pads from immersion into water deeper than a predetermined level, which may occur, e.g., under the effect of the weight of people running over the pads, the entire track is attached to stationary supports S1 and S2, e.g., by ropes 19 and 21 (also see FIG. 4) which are attached, e.g., to hooks 28 (FIG. 2). Stationary supports S1 and S2 are shown only as an example and floating objects can be used for the same purpose, provided they have sufficient buoyancy to withstand any load placed on the track.

In the case of a multipath underwater track of the type shown in FIG. 1, one track, e.g., outer track 12, can be used for walking in water and may be immersed to a depth of 1.3–1.6 m, while the other track, e.g., inner track 14, can be designed for deep water running and may have the floating element immersed to a depth of 1.6∝2.0 m. The depth adjustment is accomplished by placing appropriate loads 22 into pockets 20 of floating pads 16 and 18. On the surface of water the boundaries of the track can be marked by floating strips 34, 36, and 38 (FIG. 1) of the type used for separation of tracks in conventional swimming pools. Each boundary strip is held in place by cords (not shown) which are attached to the edges of respective underlying tracks. The space encircled by the closed-loop tracks can be used, e.g., for storing lifebelts, first-aid sets, or for rafts used by coaches, instructors, or life guards.

FIGS. 1-4—USE OF THE UNDERWATER TRACKS

Figure 3:
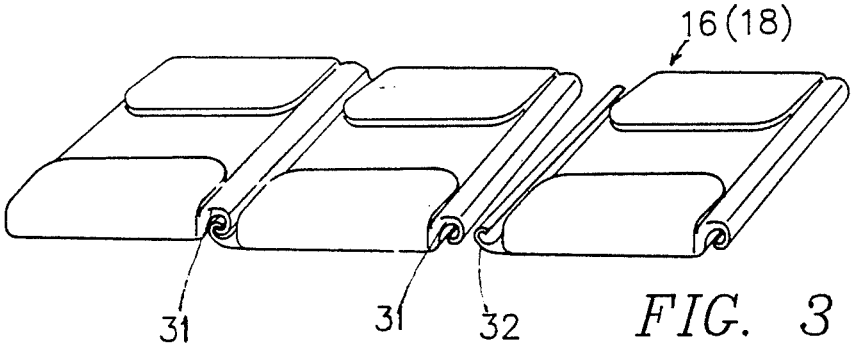
FIG. 3 is a perspective view of the floating track elements with having pivotal interconnections.

For storage and transportation, pads 16 and 18 can be disconnected from each other and conveniently stacked into piles. When a necessity for use occurs, the pads are pivotally connected to each other through hooks 28 and loops 30 or by means of hinge-like portions 31 and 32, so that they form a loop-like concentric tracks 12 and 14. The pads are loaded with appropriate weights 22, which ar placed into pockets 20 and selected in accordance with the depth to which the tracks must be submerged. The tracks are then submerged in water and connected by ropes 19 and 21 to stationary parts, such as columns S1 and S2 (FIG. 3).

One group of individuals run or walk along track 12, and the other group can use track 14. When an individual runs or walks in water, all muscles of his (her) body work, since water creates uniform resistance to movement in any direction.

FIGS. 5-8—STATIONARY POOL FOR SWIMMING, WATER WALKING AND DEEP WATER RUNNING

Figure 5:
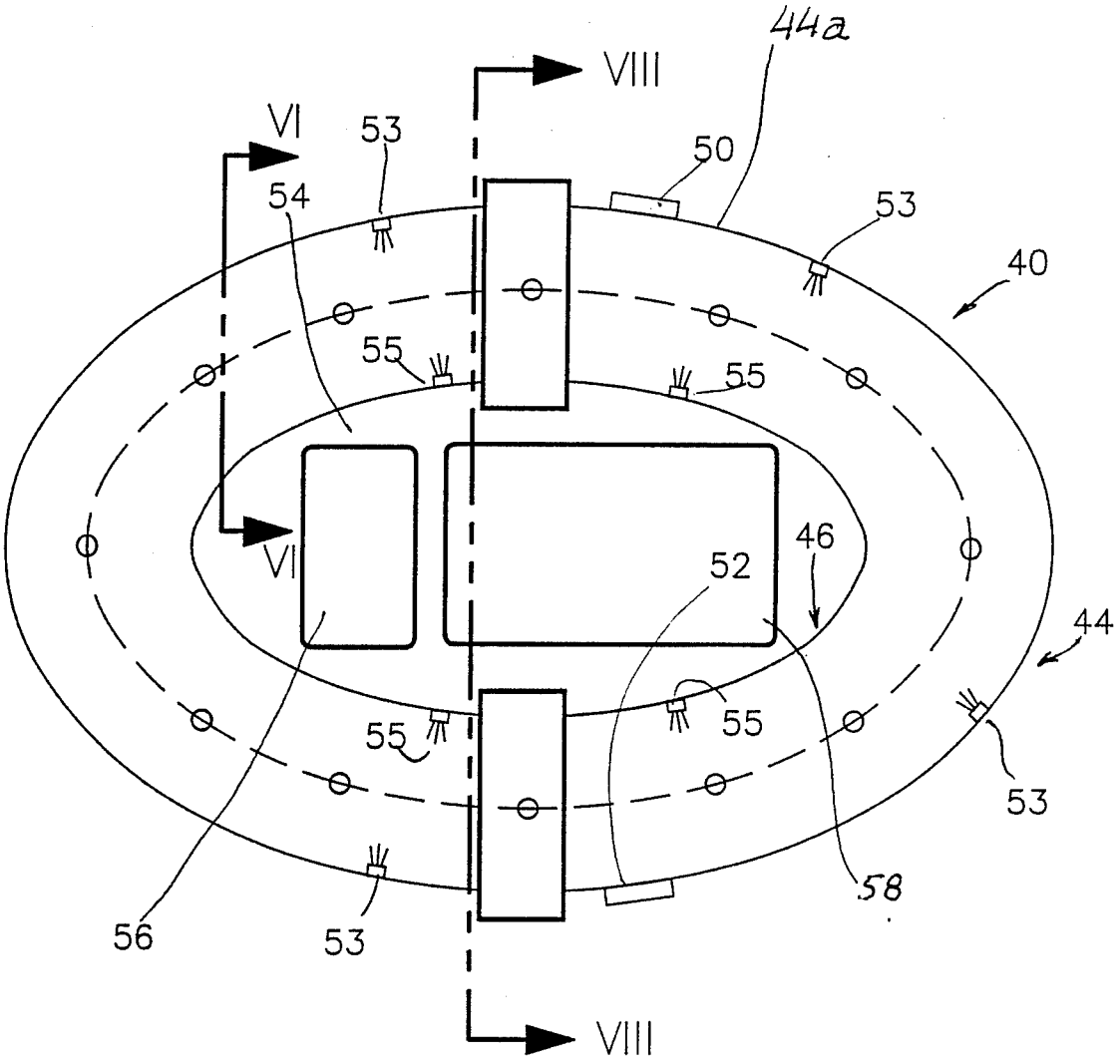
FIG. 5 is a top view of a stationary pool complex including a pool for deep water walking and running.
Figure 8:
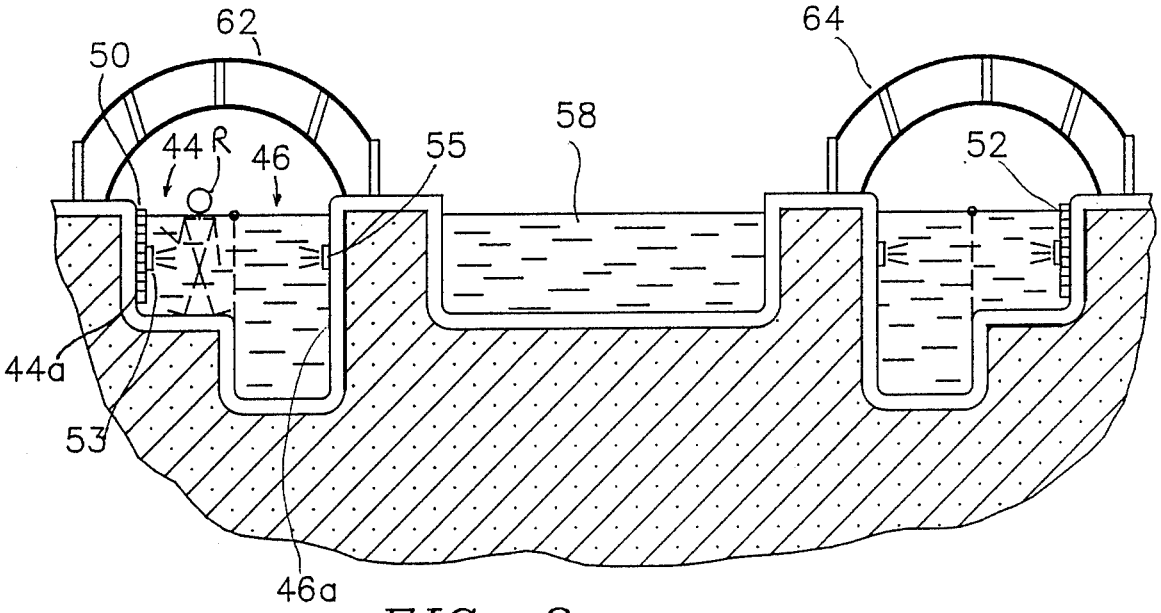
FIG. 8 is a sectional view along line VIII—VIII of FIG. 5.

FIG. 5 is a top view of a stationary water pool complex 40 whose bottom may be formed of a non-slip material. The bottom has two concentric oval tracks, i.e., an outer track 44 and an inner track 46. Profiles of these tracks are shown in FIG. 8 which is a sectional view taken along line VIII—VIII of FIG. 5. Outer track 44 has a side wall 44*a* and inner track 46 has a side wall 46*a*. Outer track 44 may be 1.4–1.6 m deep with bottom 43 having a profile of hills and valleys of the type shown in FIG. 6, a longitudinal sectional view along line VI—VI through the bottom of track 44. Experience indicates that the best results are obtained when a bottom 43 of outer track path 44 is formed as regular waves having height H between 10 cm and 30 cm and a pitch L between 40 cm and 120 cm. With such a wavy bottom, the feet of a runner R have the most favorable angle of attack and recoil from the surface of the bottom, when the foot steps onto a descending slope portion. On the other hand, the angle is not steep enough to cause the individual to fall backwards, when the runner's body is proceeding on an upward slope.

Figure 6:
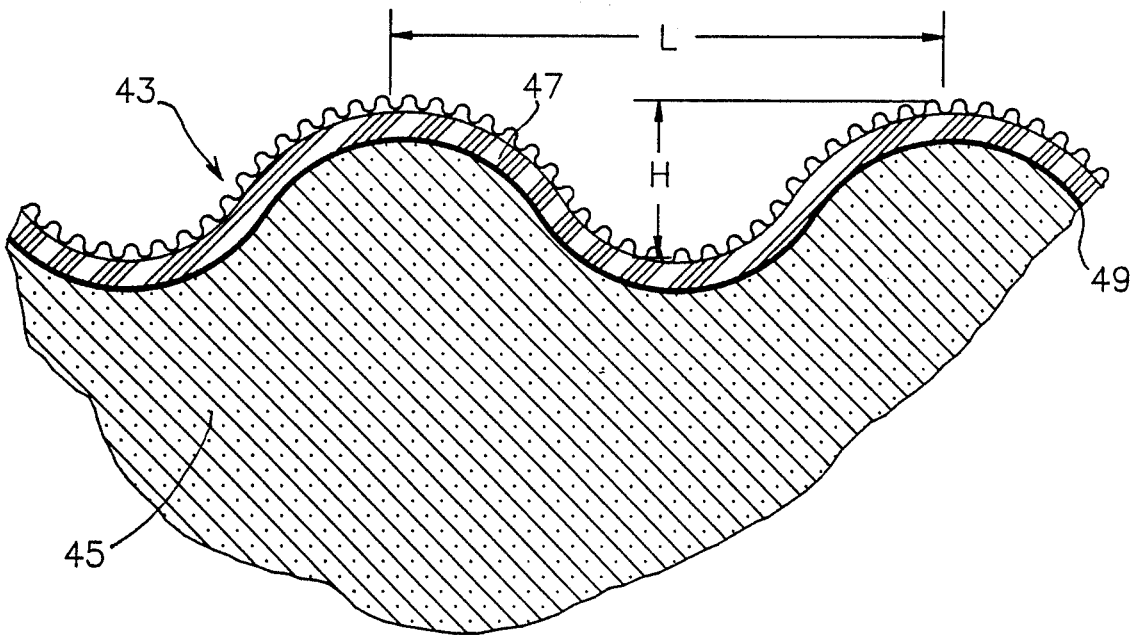
FIG. 6 is a longitudinal sectional view along line VI—VI of FIG. 5 showing a partial profile on the pool bottom.
Figure 7:
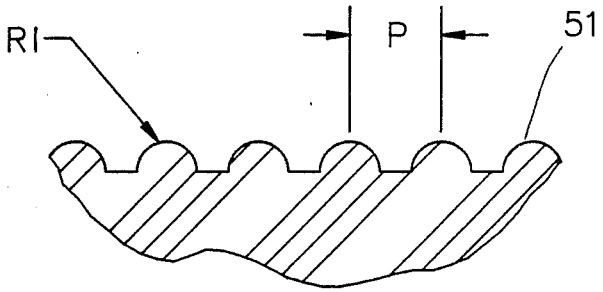
FIG. 7 is an enlarged fragmentary view of the bottom surface of the pool of FIG. 6.

The slope of bottom 43 should be made from, or coated with a material which provides sufficient coefficient of friction to prevent the runner's feet from slipping. In the embodiment illustrated in FIG. 6, the bottom is formed from concrete 45 and is coated with a layer of rubber 47. A layer of sealant 49 can be placed between rubber layer 47 and concrete 45. Rubber layer 47 may have a thickness from 1 cm to 3 cm and has hemispherical projections 51 as shown in FIG. 7, which is an enlarged fragmentary view of the part of the bottom's profile shown in FIG. 6. Projections 51 have a radius R1 of 0.5–3 cm and a pitch between adjacent projections of about 1.5–4 cm.

Although the bottom profile has a regular, in particular sinusoidal configuration, it is understood that it may have an irregular profile. However, the surface of the track's bottom should be covered with a coating which has high coefficient of friction or has projections of the type shown in FIGS. 6 and 7.

Inner track 46, which is intended for swimming or deep water running without touching the bottom, may be flat and has a depth of 2–3 m. On its side wall 44*a*, outer track 44 may have ladders 50, 52 for entering the pool. Boundaries between outer and inner tracks 44 and 46 can be marked by the same floating strips as strips 34–38 of FIG. 1.

Side walls 44*a* and 46*a* the pool may have nozzles 53 and 55 for emitting jets of water for creating resistance to walking or running in water. The jets can be adjusted to create a variation of water walking and running conditions. In combination with the wavy bottom, the variable resistance created by the jets eliminates monotony in training and creates fun. Nozzles 53 and 55 can work in an emission or suction mode. Nozzles 53 and 55 are connected to a conventional pressure/suction pumping unit in a manner known in the art.

An island 54 formed within the interior of inner track 46 can be efficiently utilized for various purposes. For example, two additional pools, such as exercise pools 56 and 58, can be constructed in island 54. If necessary, this area can be used for rest, for taking sun baths, etc.

Island 54 is connected to the main floor area surrounding the pool by arch-type bridges 62 and 64, the shape of which is shown in FIG. 8, a sectional view along line VIII—VIII of FIG. 5. Bridges 62 and 64 are high enough so that they don't obstruct individuals walking or running in the pool.

As in a conventional swimming pool, walls 44*a* and 46*a* can be lined with tiles (not shown) with the seams between the tiles being properly sealed.

The surrounding main floor area can be used for various offices and auxiliary rooms, such as a doctor's office, a physical therapy office, a sauna, a whirl-pool, etc.

If necessary, the bottom of track 44 can be formed by floating pads of the type shown in FIGS. 2 and 3. The pads can be suspended from floor area 54 and 60 to the required depth.

With the total length of the oval shaped track about 100 m, pool 40 can be used simultaneously by 50 individuals.

FIG. 9—WATER WALKING OR RUNNING POOL WITH LABYRINTH-TYPE TRACKS

Figure 9:
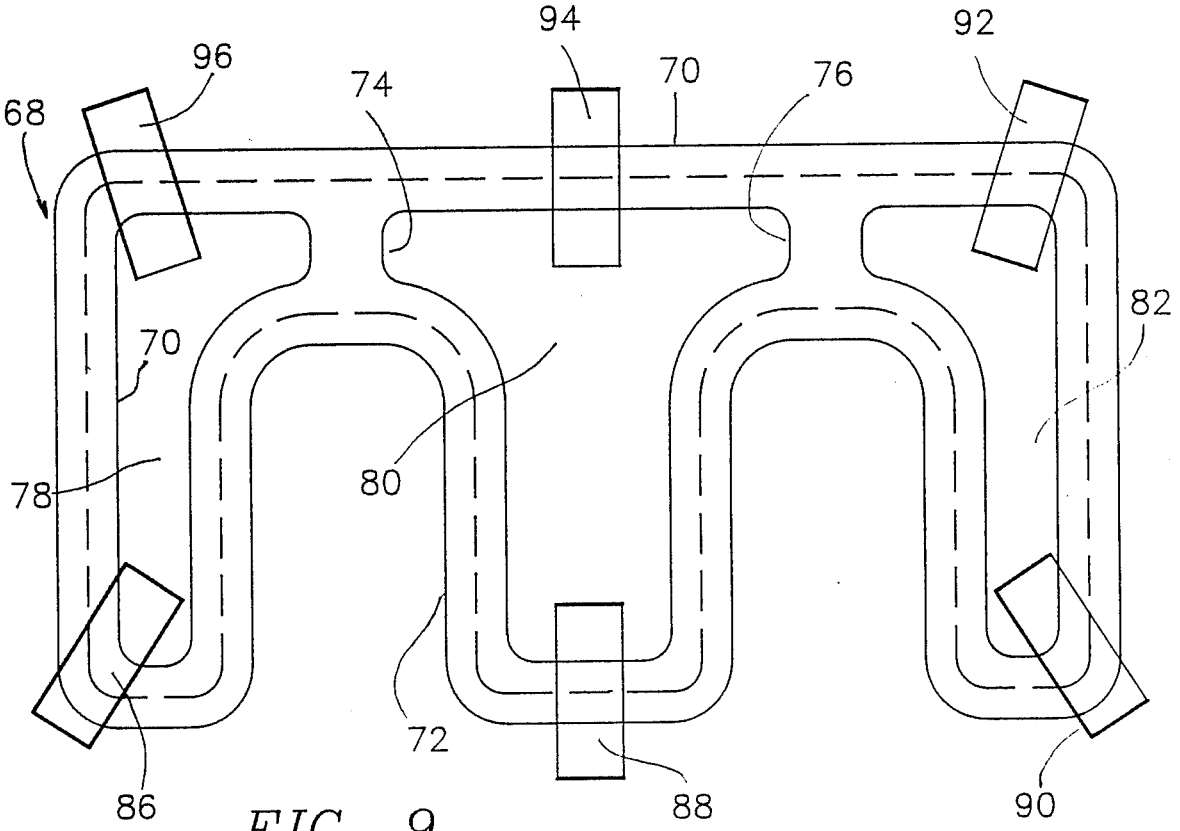
FIG. 9 is a top view of a pool having a zig-zag configuration.

Instead of an oval-shaped configuration with a center area, the pool of the invention may have a zig-zag configuration as shown at 68 in FIG. 9.

Figure 4:
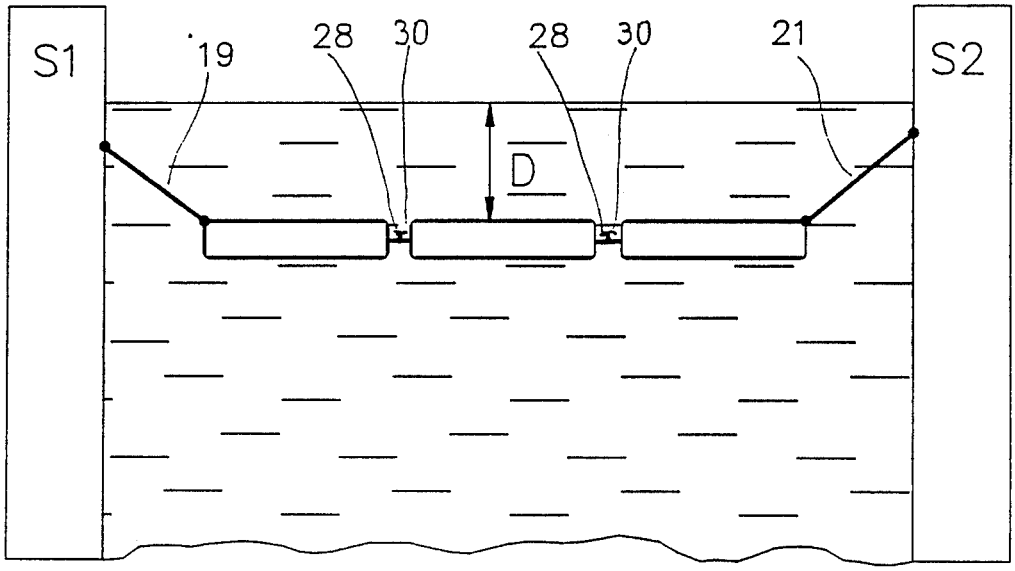
FIG. 4 is a view illustrating a position of the floating underwater track supported by stationary objects.

Except for its zig-zag configuration, the pool of this type remains the same as that described in connection with FIGS. 4–6, i.e., it has two tracks, one for water walking, another for water running; it may have an uneven bottom or a bottom formed by suspended floating pads, etc.

Track 68 has a closed configuration formed by a linear portion 70 and a zig-zag or sinusoidal portion 72. The segments of the sinusoidal portions are connected to linear portion 70 by connecting portions 74 and 76. The underwater track of this type creates greater possibilities for variation of the load, as one can use either a short or a long-perimeter loop. Also this track may have capacity to accommodate more simultaneously exercising individuals. Thus it should have a greater number of entering ladders than the circular or oval-shaped track. In the case illustrated in FIG. 8 the pool has two sinusoidal portions and three respective islands 78, 80, and 82. The islands are connected with a main floor area 84 by bridges 86–96 of the same type as those shown in FIG. 7. The island area can be used in the same manner as described above.

FIGS 5-9—USE OF STATIONARY POOLS FOR WATER WALKING AND RUNNING

In use of a stationary pool having different-depth tracks for walking and running in water, individual R may use the outer track for walking and running on the pool's bottom and the inner track for running in water without touching the bottom. In the case of the zig-zag pool shown in FIG. 9, beginners can exercise on a smaller loop which has a shorter perimeter, while more trained individuals can run or walk along a longer loop. When individual R runs or walks in water, all muscles of the body work, since water creates resistance to movement in any direction. Rubber-coated bottom 43 with projections 51 prevents slipping and improves recoil of the runner's feet from the surface of the bottom. The waviness of the bottom eliminates monotony and imitates actual running conditions. In addition to the uneven bottom, resistance to running or walking can be varied by means of jet nozzles 53 and 55 installed on the path of the runner.

CONCLUSION, RAMIFICATIONS AND SCOPE

Thus it has been shown that the invention provides a universal underwater track and pool which can be used for water walking or deep water running. Also it makes it possible for a person to train all groups of muscles, i.e., muscles of legs, shoulders, etc. It is simple in construction, has no moveable parts, allows simultaneous training of several people or a team, eliminates the factor of monotony, and has variable and adjustable conditions for water walking or running. It can be quickly installed in any existing pool, lake, etc., without interfering with swimming.

Although the tracks and pools of the invention have been described with reference to specific embodiments of their parts and elements, it should be understood that the specific constructions have been given only as examples and that many modifications and changes are possible within the scope of the invention. For example, although pads 16 and 18 have been shown as made from floating material, they may comprise inflated bodies. The underwater floating track is shown as having a loop-like configuration, but it may comprise two, three, or more parallel and linear tracks. The tracks can be suspended from a ship, or can be supported by pillars driven into the soil of the water-basin bottom. Adjacent pads 16 or 18 can be interconnected by hinges. The bottom of tracks in stationary pools may have an arbitrary profile. The tracks in irregular pools may have any configuration, e.g., in the form of two interconnected sinusoidal paths, etc. The area of the islands can be used for any purposes required by specific conditions for training or rehabilitation of individuals exercising in the pool. The pools, as well as the tracks, may have any suitable dimensions. Jet nozzles 53 and 55 may be located in the bottom of the track or in any other position under water. It is also understood that the depth ranges indicated in the description are selected on the basis of an average height of a man or a woman, and that these ranges can be adjusted for children or for athletes of tall height, e.g., basketball players. Therefore the scope of the invention should be determined not by the examples given, but rather by the appended claims and their legal equivalents.

I claim:

1. A pool for underwater walking and running comprising a closed-loop water track having at least two concentric tracks of different depths, and adjustment means for varying conditions for underwater walking and running, at least one of said tracks having a depth from the water surface to the bottom of said track not exceeding the height of a human body of a predetermined size for walking and running on said bottom, while the other of said tracks has a depth exceeding the height of said human body for running in water without touching the bottom, said one track for walking and running having an uneven undulating bottom and a surface having high coefficient of friction, the height of said unevenness being smaller than 30 cm.

2. The pool of claim 1 wherein said bottom of said one track for walking and running has a sinusoidal profile in the longitudinal direction of the track with the pitch of said sinusoidal profile being within the range of 30 cm to 120 cm and with the height of said sinusoidal unevenness between 10 and 30 cm, the surface of said sinusoidal profile being coated with a rubber layer having a plurality of projections on its surface, said projections having a height of 0.5 cm to 3.0 cm and a pitch between the adjacent projection within the range of 1.5 cm to 4 cm.

3. The pool of claim 2 wherein said one track is an outer track with a depth from the surface of water to the bottom of the track within the range of 0.5 m to 1.8 m, and said other track is an inner track path with a depth from the surface of water to the bottom of the track within the range of 1.8 to 2.5 m.

4. The pool of claim 1 wherein said adjustable means comprises a plurality of nozzles which create moveable streams of water on said tracks for changing resistance to walking and running, said nozzles being arranged on opposite facing sides of said one track and said other track.

5. The pool of claim 1 wherein the area encircled by said tracks is a utility area associated in connection with the use of said pool.

6. The pool of claim 5 where said utility are has at least one auxiliary pool.

7. The swimming pool of claim 5 wherein said encircled area is connected to the area surrounding said closed-loop water track by at least one bridge.

8. The pool of claim 1 which in a top view has a zig-zag configuration formed by at least two interconnected closed-loop tracks, so that a user can walk and run along a short track or along a track having a longer perimeter.

9. A pool for underwater walking and running having in a top view a zig-zag configuration formed by at least two closed-loop water tracks each having at least two concentric tracks of different depth, and adjustable means for varying conditions for underwater walking and running, at least one of said tracks having a depth from the water surface to the bottom of this track not exceeding 1.8 m and is intended for walking and running on said bottom, while at least one of said other tracks has a depth exceeding 1.8 m and is intended for running in water without touching the bottom, said means for varying conditions of running and walking in water comprising nozzles for creation streams of water in said tracks and a variable-depth bottom of said at least one of said tracks.

10. The swimming pool of claim 9 wherein said variable-depth bottom has a sinusoidal profile with the pitch of the sinusoidal wave within the range of 30 cm to 120 cm and with the height of said sinusoidal wave within the range of 10 cm to 30 cm, said bottom being coated with a rubber layer, the surface of said rubber layer having a plurality of hemispherical projections with the height from 0.5 cm to 3.0 cm, the distance between adjacent projections being within the range of 1.5 cm to 4 cm.

* * * * *